US008251831B2

(12) United States Patent
Frehner

(10) Patent No.: US 8,251,831 B2
(45) Date of Patent: Aug. 28, 2012

(54) RAMP

(76) Inventor: Brian Frehner, Sydney (AU)

( * ) Notice: Subject to any disclaimer, the term of this patent is extended or adjusted under 35 U.S.C. 154(b) by 166 days.

(21) Appl. No.: 12/682,573

(22) PCT Filed: Oct. 10, 2008

(86) PCT No.: PCT/AU2008/001505

§ 371 (c)(1),
(2), (4) Date: May 24, 2010

(87) PCT Pub. No.: WO2009/046501

PCT Pub. Date: Apr. 16, 2009

(65) Prior Publication Data

US 2010/0255918 A1 Oct. 7, 2010

(30) Foreign Application Priority Data

Oct. 12, 2007 (AU) ..... 2007905589

(51) Int. Cl.
*A63C 19/10* (2006.01)
*A63C 19/00* (2006.01)

(52) U.S. Cl. ..... 472/89; 472/91

(58) Field of Classification Search ..... 472/88–91; 296/21, 26, 181
See application file for complete search history.

(56) References Cited

U.S. PATENT DOCUMENTS

| | | | | |
|---|---|---|---|---|
| 4,285,514 | A * | 8/1981 | Romero | 472/89 |
| 5,749,615 | A | 5/1998 | Itson | |
| 6,350,174 | B1 * | 2/2002 | Halford et al. | 446/444 |

FOREIGN PATENT DOCUMENTS

| | | | |
|---|---|---|---|
| CH | 694522 | A5 | 3/2005 |
| DE | G9205231.2 | U1 | 7/1992 |
| DE | 19717491 | C1 | 10/1998 |
| DE | 29817854 | U1 | 3/1999 |
| GB | 2397247 | A | 7/2004 |

OTHER PUBLICATIONS

PCT/AU2008/001505, International Preliminary Report on Patentability, Apr. 13, 2010.

* cited by examiner

*Primary Examiner* — Kien Nguyen
(74) *Attorney, Agent, or Firm* — Kilpatrick Townsend & Stockton LLP

(57) ABSTRACT

A ramp (1) for sporting activities, the ramp (1) including a plurality of ramp portions (10,15,20), at least one of the plurality of ramp portions (10, 15, 20) being moveable with respect to another one of the plurality of ramp portions (10, 15, 20) such that the ramp (1) forms an open ramp position or a closed ramp position.

16 Claims, 11 Drawing Sheets

RAMP

FIELD OF THE INVENTION

The present invention relates to an apparatus such as a ramp, and in one particular example, a ramp for sporting activities such as skateboarding or the like.

DESCRIPTION OF THE BACKGROUND ART

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

Presently, ramps such as those used for various sports like skateboarding or the like, consume a large amount of public space and are typically fixed in position. Accordingly, they are often susceptible to and suffer damage from variable weather conditions, use, and vandalism. As a result, ramps often need to be robust, and are typically heavy, which makes them expensive to build and maintain.

The present invention seeks to substantially overcome, or at least ameliorate, one or more disadvantages of existing arrangements, or to provide an alternative to existing arrangements.

SUMMARY OF THE PRESENT INVENTION

In a first broad form, there is provided a ramp for sporting activities, the ramp including a plurality of ramp portions, at least one of the plurality of ramp portions being moveable with respect to another one of the plurality of ramp portions such that the ramp forms an open ramp position or a closed ramp position.

According to one example, the sporting activity includes skateboarding.

With respect to a further example, the plurality of ramp portions include a main frame having a substantially flat surface, and two side frames, each of the two side frames having substantially arcuate surfaces, wherein the two side frames are attached to either side of the main frame, such that when in the open position the flat and arcuate surfaces form a substantially smooth surface for skateboarding.

According to another aspect, the two side frames are moveable towards the main frame, and are hingably attached to the main frame such that the two side frames are rotateable with respect to the main frame for placing the two side frames on the main frame and rotating the two side frames to by a ninety degree angle thereby forming the closed ramp position.

With respect to a further example, the two side frames are attached to the main frame with at least one lever, the lever being used to lift and rotate the two side frames.

Referring to yet another example, the at least one lever includes one or more wheels for aiding movement of the ramp portions.

According to another example, the two side frames includes wheels for aiding movement of the ramp portions.

In yet a further form, each of the two side frames have a handrail attached thereto.

Referring to another example, the two side frames include a box-shaped frame supporting the arcuate surface.

With respect to another form, the two side frames include a triangular prism shaped frame supporting the arcuate surface.

In one particular example, each of the two side frames include a supporting device for supporting the side frame when in the open position.

In a second broad form, there is provided a method for moving a ramp between an open position and a closed position, the ramp including a plurality of ramp portions, at least one of the plurality of ramp portions being moveable with respect to another one of the plurality of ramp portions such that the ramp forms the open ramp position or the closed ramp position.

It will be appreciated that the broad forms of the invention and particular examples described may be used individually or in combination.

BRIEF DESCRIPTION OF THE DRAWINGS

An example of the present invention will now be described with reference to the accompanying drawings, in which.

MODES FOR CARRYING OUT THE INVENTION

Figure 1:
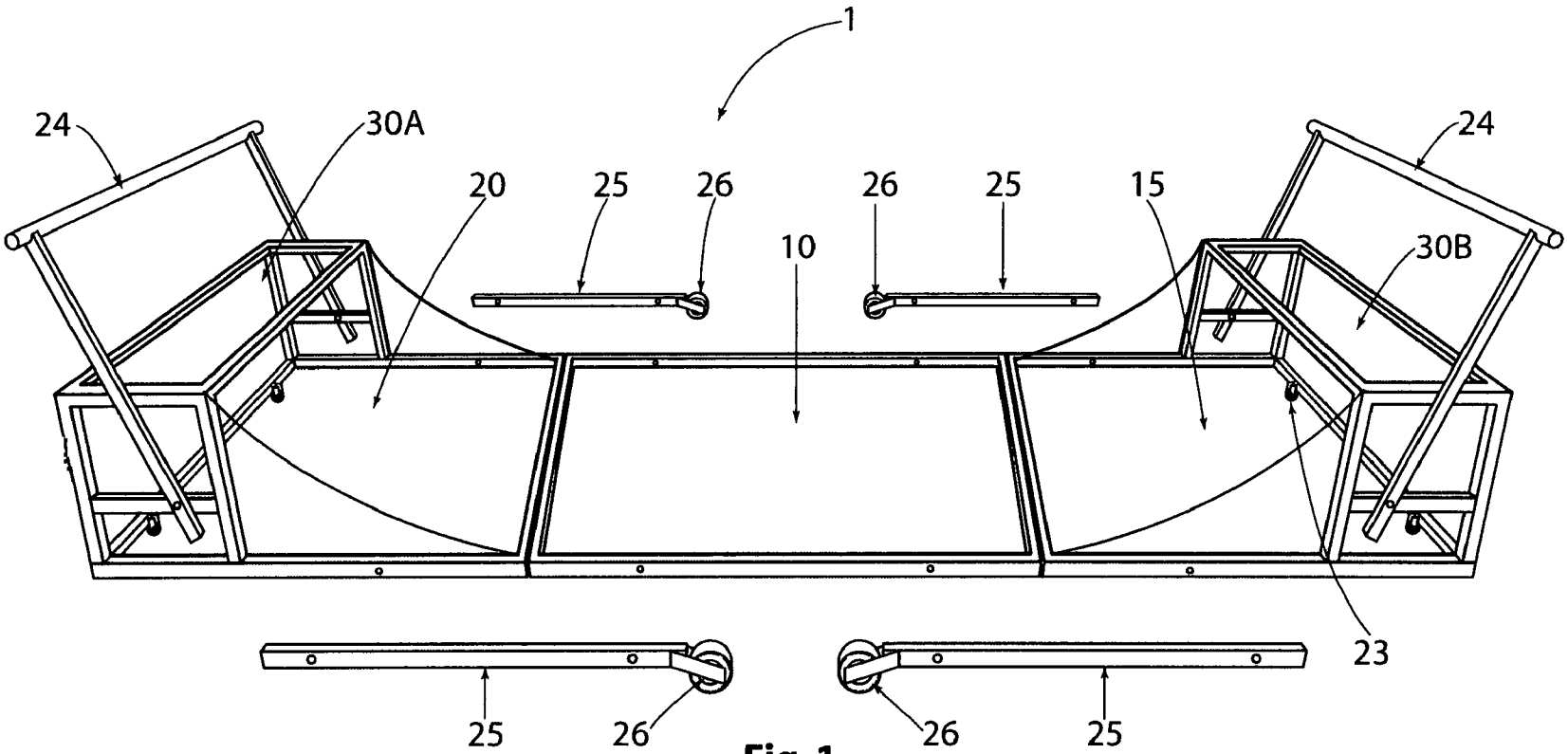
FIG. 1 is a schematic diagram of an example of a ramp.

FIG. 1 shows an example of an apparatus, which in this case is a ramp 1, which can be used for various sporting activities, such as skateboarding or the like.

In this particular example, the ramp 1 includes a plurality of ramp portions 10, 15, and 20, where at least one of the plurality of ramp portions 10, 15, and 20 is moveable with respect to another one of the plurality of ramp portions 10, 15, 20, such that the ramp 1 forms an open ramp position or a closed ramp position (as shown for example in FIGS. 8 and 9 and further described below).

FIG. 1 also shows that the plurality of ramp portions 10, 15, 20 include a main frame 10 having a substantially flat surface 5, and two side frames 15, 20, each of the two side frames being able to support substantially arcuate surfaces 7, where the two side frames 15, 20 are attached to either side of the main frame 10, such that when in the open position, the flat and arcuate surfaces 5, 7, form a substantially smooth surface for sporting activities (such as skateboarding).

The two side frames 15, 20 are moveable towards the main frame 10, and are hingably attached to the main frame 10 such that the two side frames 15, 20 are rotateable with respect to the main frame 10 for rotating the two side frames 15, 20 to/by a ninety degree angle and placing the two side frames 15, 20 on the main frame 10, thereby forming the closed ramp position.

In order to assist in moving the side frames 15, 20, the two side frames 15, 20 can be attached to the main frame 10 with at least one lever 25, where the lever 25 can be used to lift and rotate the two side frames 15, 20.

In the example of FIG. 1, the ramp 1 also includes wheels 26 and 23. The wheels 26 are placed on one end of the lever 25 and can be used to move the side frames 15, 20 towards the main frame 10, prior to levering the side frames 15, 20 onto the main frame 10. The wheels 23 are generally located at the base of the side frames 15, 20 and can be used to move the ramp 1 when in the closed (or open) position. The use of the wheels 26 and 23 are further described below and are shown in FIGS. 6 and 7A to 7D.

The ramp 1 of FIG. 1 can also include handrails 24, where each side frame 15, 20 has attached thereto handrails 24. The handrails 24 can be used by user's of the ramp 1 to aid in moving and rotating the side frames 15, 20 to form the closed position. Furthermore, the handrails 24 can be used by sportspeople when the ramp 1 is in the open position. For example, the handrails 24 can be held on to by skateboarders, when standing on the side frames 15, 20 prior to skating down the ramp 1.

In this particular example, it will be appreciated that the two side frames 15, 20 include a box-shaped frame supporting the arcuate surface 7. However, as described further below many other shaped frames can be used, which can include (but not limited to) a triangular prism shaped frame supporting the arcuate surface 7, where each of the two side frames include a supporting device (which is further described below and shown in FIGS. 10 to 15) for supporting the triangular prism shaped side frame when in the open position.

A further description of the example ramp 1 of FIG. 1 is given below.

Further Examples

Accordingly, FIG. 1 also shows an example of a foldaway type skateboard mini-ramp which in this example is made out of three base frames 10, 15, and 20, which are rectangular in shape. In this particular example, the main frame 10 is the middle frame, frame 15 is placed on one side of frame 10 and frame 20 is placed on the other side of frame 10. In this particular example, frames 10, 15, and 20 are held together with four levers 25 which have through holes which align with respective through holes of the frames 10, 15, and 20 such that the levers 25 can be attached to the frames 10, 15, and 20 (this is further described below).

As discussed above, also shown in FIG. 1 are the two box-shaped frames 30A and 30B, where each box-shaped frame 30A, 30B is fitted on respective frames 15 and 20. Each of the box-shaped frames 30A, 30B have handrails 24 which are pinned onto the box-shaped frames 30A, 30B and can function to provide a safety rail when the ramp is in use (such that the handrails can be held by skateboarders or the like, when skateboarders are on top of the side frames 15, 20), and can also be used to aid in folding the ramp by helping to push the side frames 15, 20 onto the main frame 10.

Figure 2:
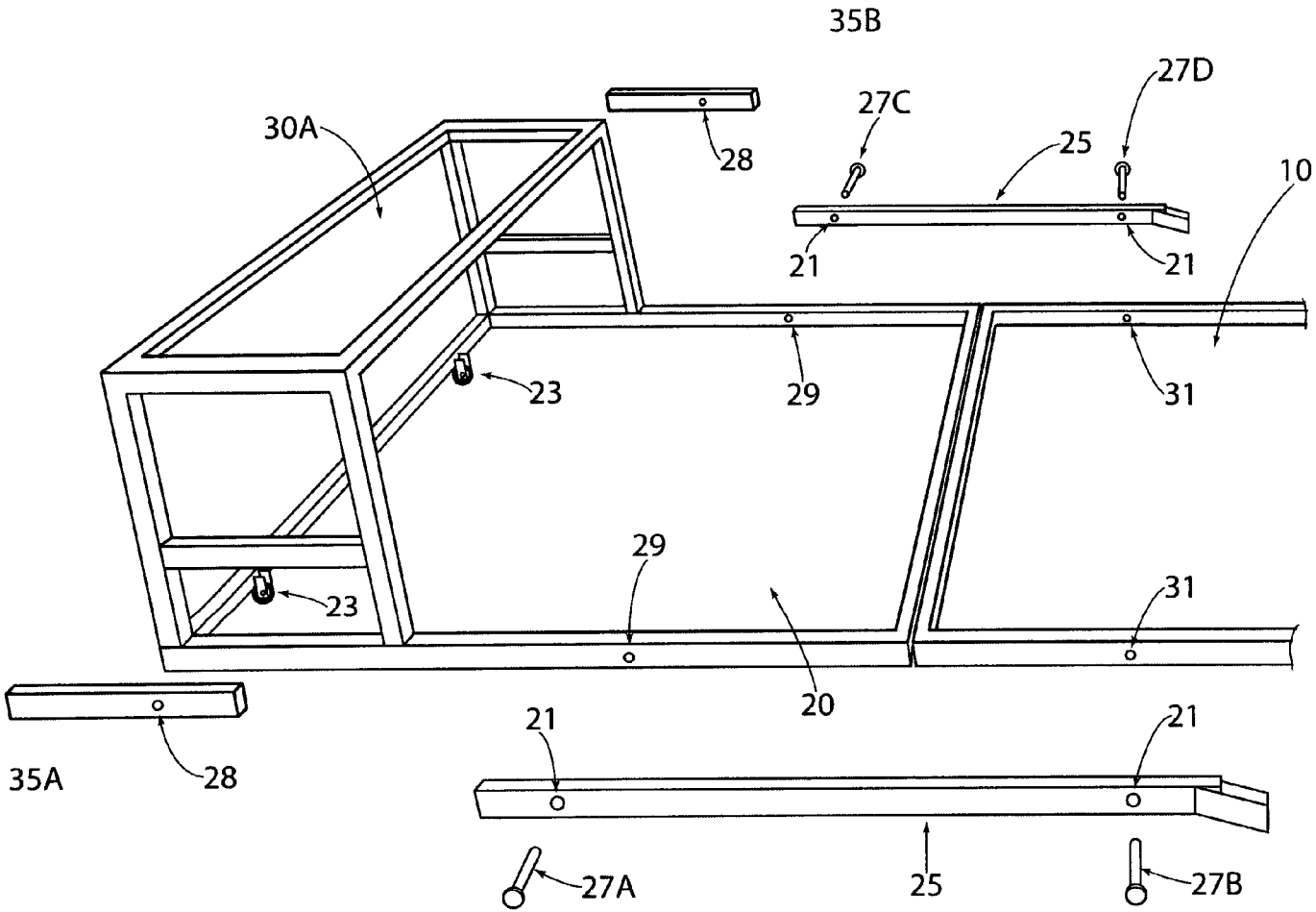
FIG. 2 is a schematic diagram of an example of a ramp portion of the ramp of FIG. 1.

FIG. 2 shows and example of a box-shaped frame 30A that is fitted to (in the case the top of) frame 20. FIG. 2 also shows that frames 10 and 20 are joined together using levers 25 which are placed on either sides of frames 10 and 20. Attachment means such as pins 27A to 27D are used with respective levers 25 to attach the levers 25 with the frames 10 and 20. The attachments occur with the aid of through holes 31 and 29 on both sides of frames 10 and 20 which can enable the use of pins 27A to 27D with respective ends of levers 25 and their respective through holes of the levers 21, in order to lock them together. Notably, each side (35A and 35B) of the box-shaped frame 30A, there is a rotating point with through hole 28, which can be used to attach a handrail to the frame 30A (this is discussed further below).

Figure 3:
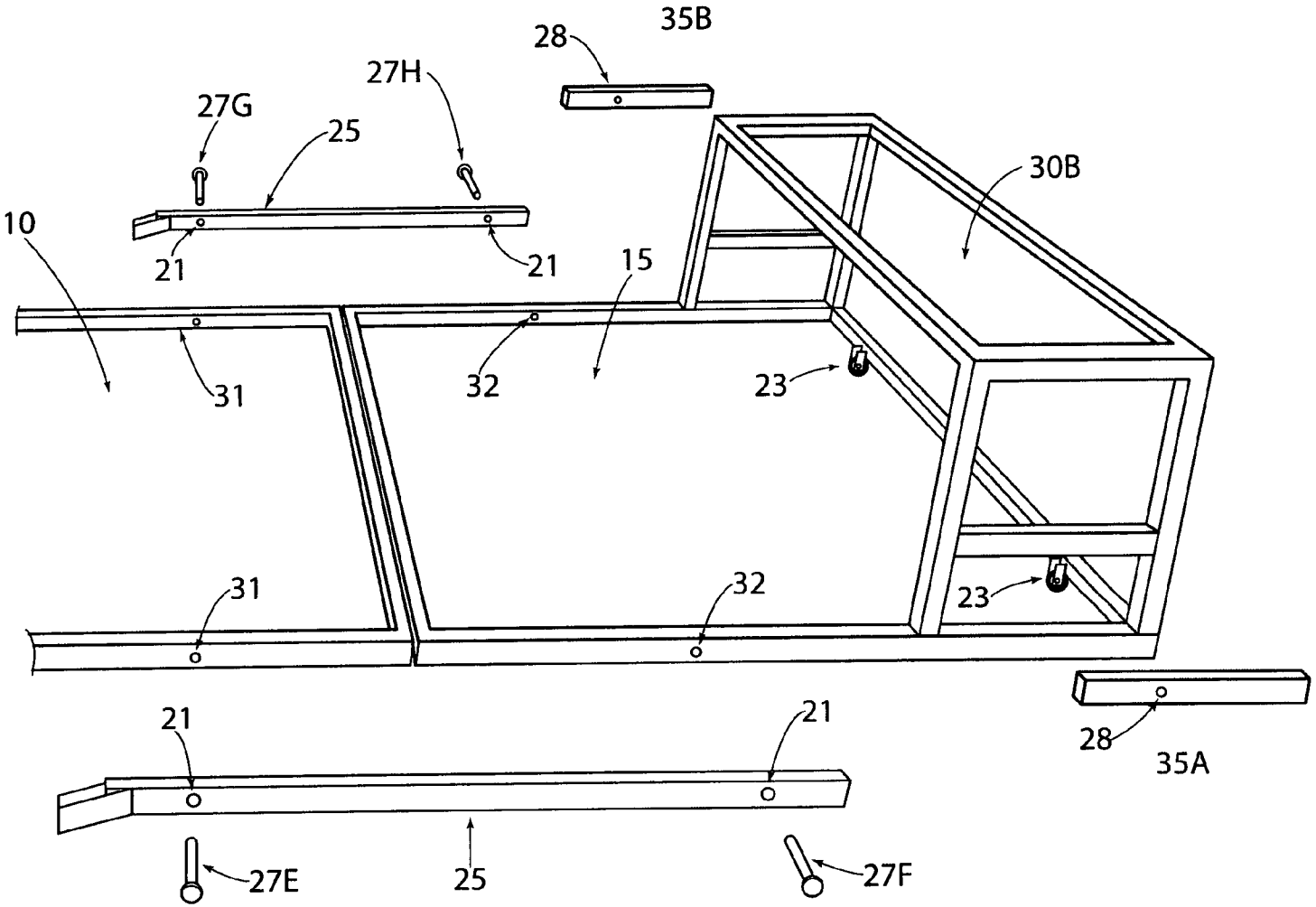
FIG. 3 is schematic diagram of an example of another ramp portion of the ramp of FIG. 1.

Similarly with respect to frame 15, as shown in FIG. 3, the frame 15 can be fitted with a box-shaped frame 30B. FIG. 3 also shows that frames 10 and 15 can be held together with respective levers 25 that have also through holes 21 on each end. The levers 25 are generally placed on opposing sides of the frames 10 and 15. The pins 27E and 27F aid to attach a lever 25 with the frames 10 and 15 by passing through holes 31 and 32. Similarly, pins 27G and 27H can be used to attach a lever 25 to the opposing side of the frames 10 and 15, by passing through respective holes 21, 31 and 32, in order to hold the frames 10 and 15 in place. Notably, each side (35A and 35B) of the boxed-shaped frame 30B has a rotating point with through hole 28

Although the presently described ramp 1 uses levers 25 to attach the frames 10, 15, and 20 together, it will be appreciated that any form of attachment means can be used. Furthermore, in this particular example, the levers 25 are hingably attached (and it will be appreciated that they can be attached by any means) and can pivot such that the side frames 15, 20 are rotated to be able to sit on top of the main frame 10.

Figure 4B:
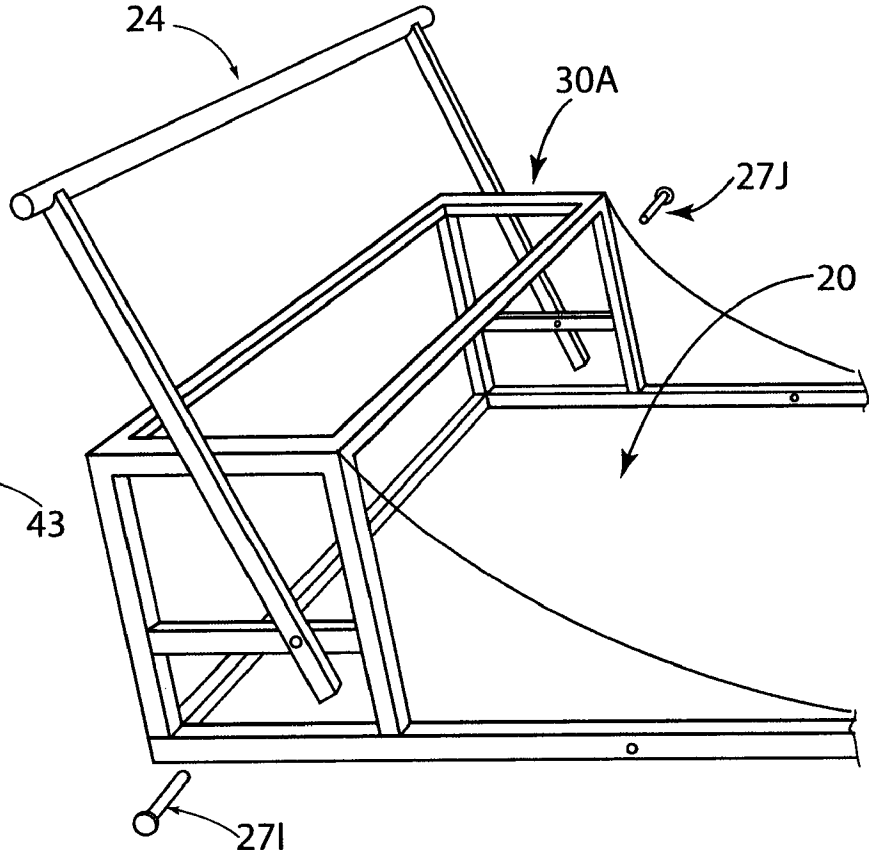
FIG. 4B is a schematic diagram of an example of a side frame of the ramp of FIG. 1 with the handrail of FIG. 4A.
Figure 4A:
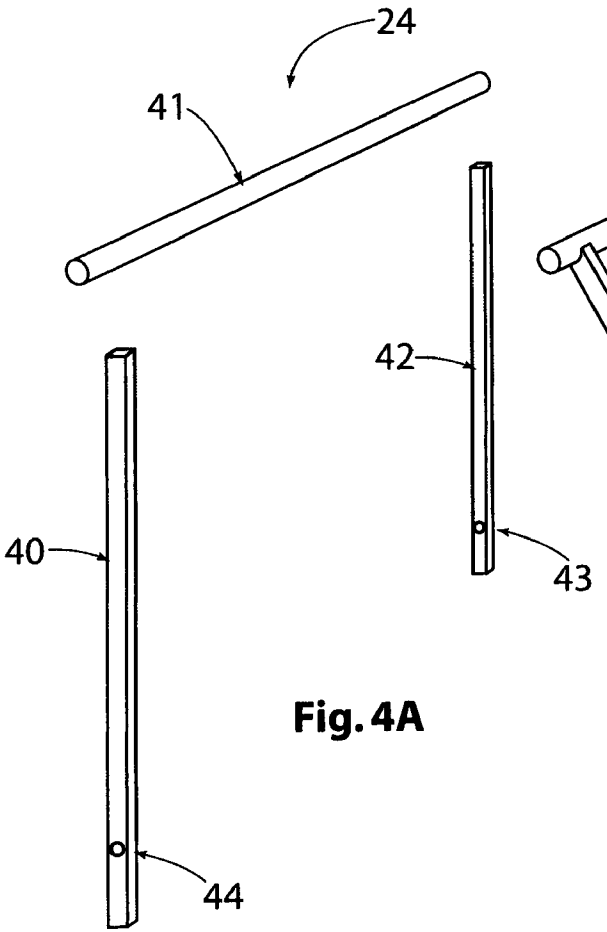
FIG. 4A is a schematic diagram of an example of a handrail which can be used with the ramp of FIG. 1.
Figure 5A:
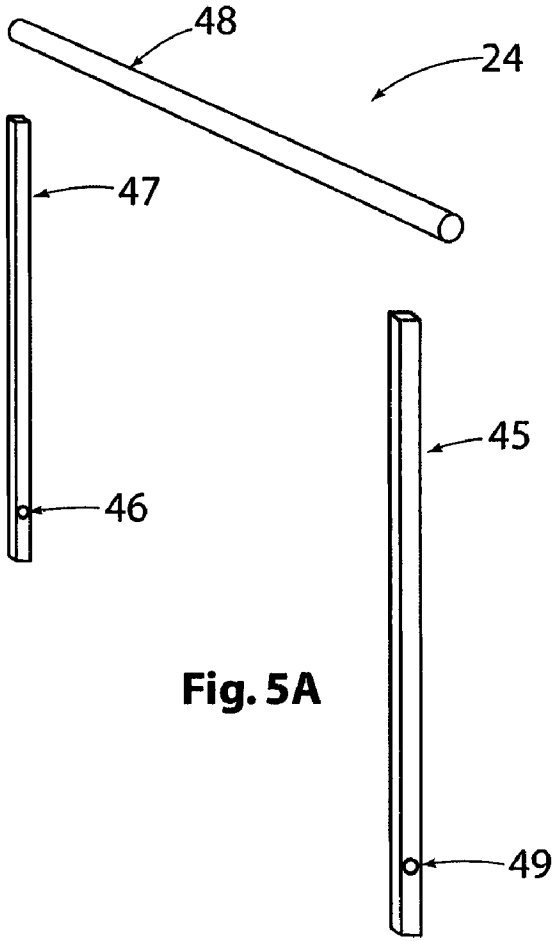
FIG. 5A is a schematic diagram of an example of another handrail which can be used with the ramp of FIG. 1.
Figure 5B:
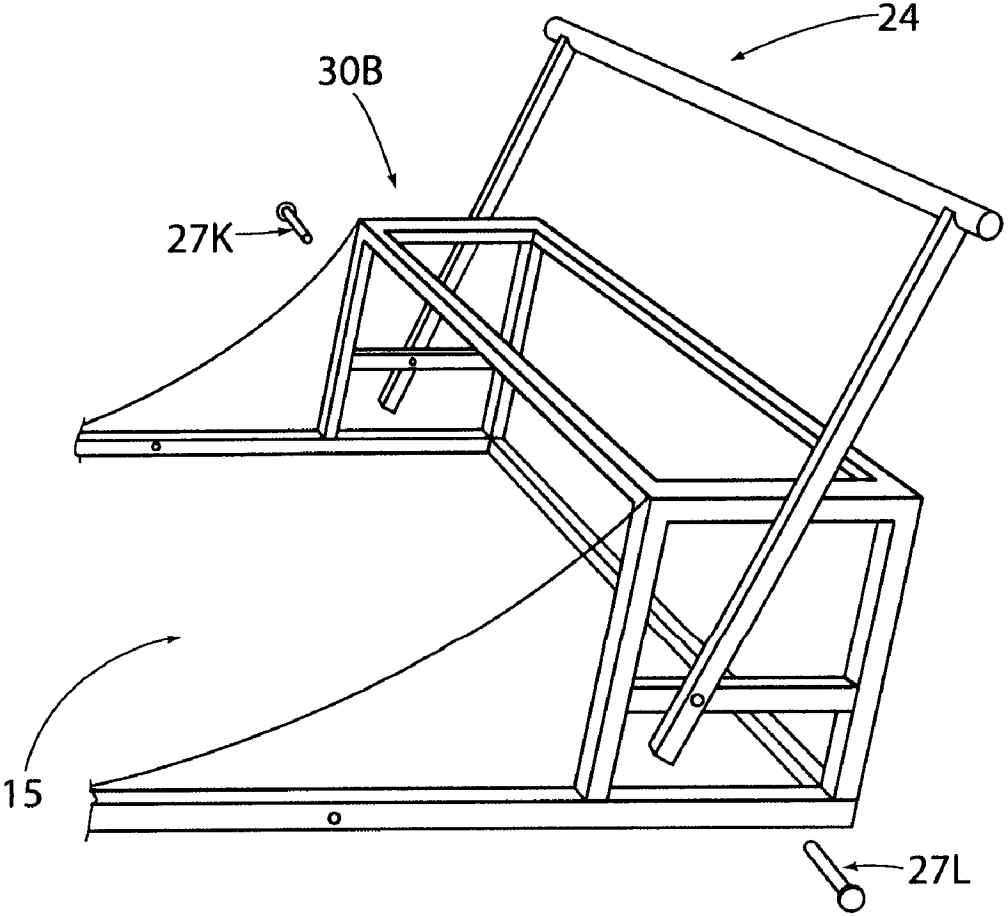
FIG. 5B is a schematic diagram of an example of another side frame of the ramp of FIG. 1 with the handrail of FIG. 5A.

FIGS. 4A and 4B show an example handrail 24 which can be used in conjunction with the box-shaped frame 30A. The vertically extending portions 40 and 42 (which can extend vertically from the frame 30A) of the handrail 24 have through holes 43 and 44 Thus the portions 40 and 42 can be attached to the frame 30A with the use of pins 27I and 27J. A horizontal portion 41 is joined to the vertically extending portions 40 and 42 to form (in this particular example) the handrail 24 for section 20.

Similar to the handrail of FIGS. 4A and 4B, FIGS. 5A and 5B shows an example handrail 24 for section 15, which in this example is made with vertically extending portions 45 and 47 that are fitted with the aid of pins 27K and 27L at points 49 and 46 to each side of the box-shaped frame 30B. The pins 27K and 27L secure the handrail into position on the frame 15. Furthermore, the handrail 24 includes a horizontally extending portion 48 which joins the two vertical portions 45 and 47, thereby forming the handrail 24.

Notably, it will be appreciated that the handrail 24 described herein can be made in numerous ways, and in one further example, the handrail can be made out of one integral part by bending various portions in order to achieve the desired shape.

Figure 6:
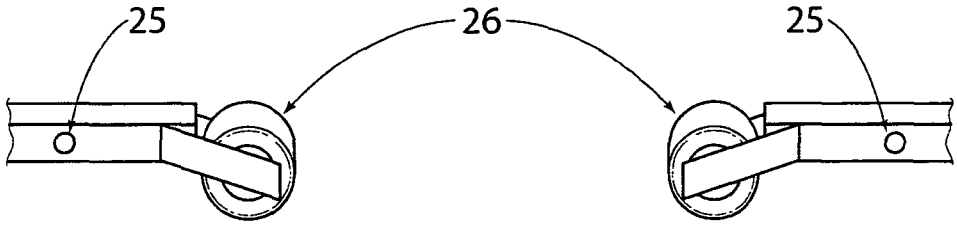
FIG. 6 is a schematic diagram of an example of wheels used with/on the ramp of FIG. 1.
Figures 7A, 7C, 7D:
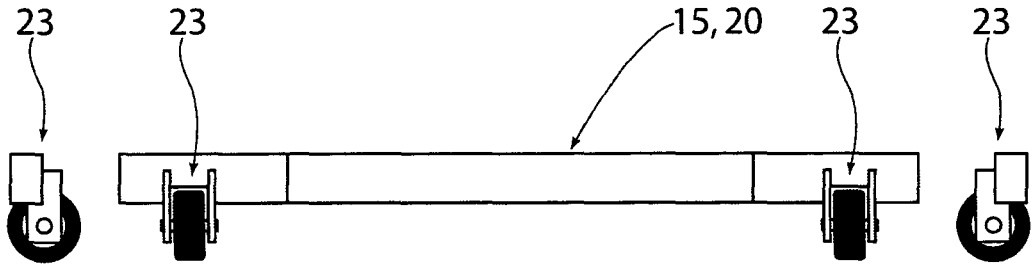
FIGS. 7A to 7D are schematic diagrams of an example of the wheels of FIG. 6.
Figure 7B:
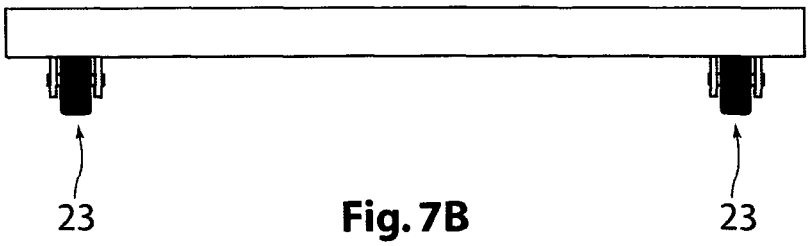

Referring to FIG. 6, FIG. 6 shows an example of the levers 25 fitted with wheels 26. It will be appreciated that in one particular example, the wheels 26 can allow the ramp to be rolled away when in the closed (or parked position), which is further shown in FIG. 9.

FIG. 7 shows an example of two guide wheels 23 which can be placed on the outer cross section of frames 15 (as further shown in FIG. 2) and 20 (as further shown in FIG. 3). In this particular example, the guide wheels 23 can assist in the way in which the ramp 1 is folded towards the middle (main frame 10) by rolling the side frames 15 and 20 along the floor and ending up on the middle/main frame 10.

Figure 8:
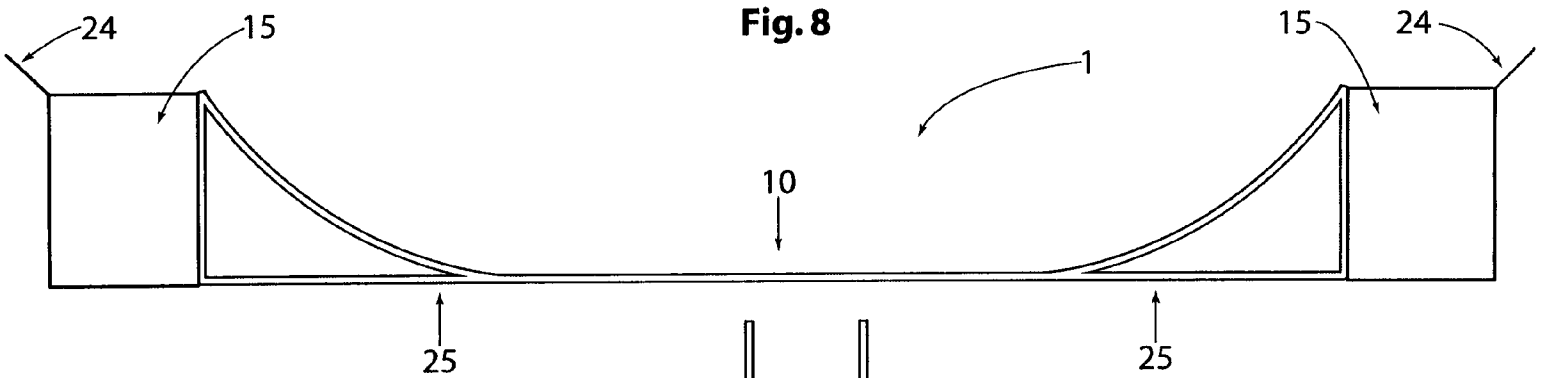
FIG. 8 is a schematic diagram of an example of the ramp of FIG. 1 in an open position.

The example in FIG. 8 shows that the ramp 1 can be folded from both sides towards the middle or main frame 10. This can be achieved with the use of the handrails 24 on frame 15, where the frame 15 can be raised by the use of the hand rails 10 towards the frame 10 into a vertical position with help of the levers 25. Similarly, the frame 20 can also be levitated with the use of levers 25 so that the box-shaped frame 20 is rotated to stand on the frame 10.

Figure 9:
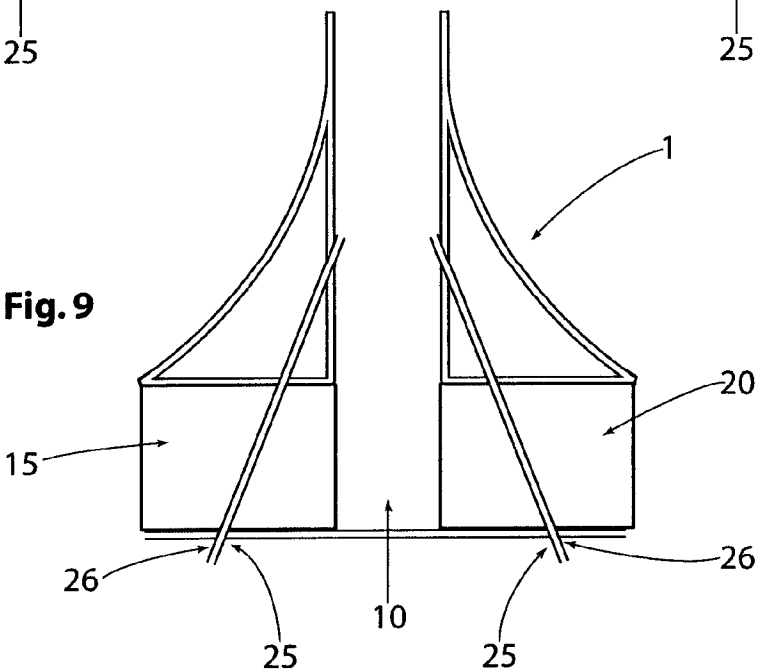
FIG. 9 is a schematic diagram of an example of the ramp of FIG. 1 in a closed position.

It will be appreciated that in this folded or closed position, the ramp 1 can gain the space saving advantage as illustrated in FIG. 9. Furthermore, the wheels 26 fitted on levers 25 can result in the foldable ramp to be moved with ease anywhere needed.

Notably, FIG. 9 shows that when in the closed position, the arcuate surfaces 7 of the ramp portions 15, 20 face away from each other (as the ramp portions 15, 20 are rotated by an angle of 90 degrees when placed on top of the main ramp portion 10). However, it will be appreciated that the ramp 1 can be folded in a variety of ways and it is not necessary that the arcuate surfaces 7 of the ramp portions 15, 20 face away from each other.

FIGS. 10 to 15 show another example of a ramp 1 that is able to be moved between open and closed positions. In this particular example, it will be appreciated that the ramp 1, when in the closed position is smaller than the ramp of FIGS. 1 to 9, and can accordingly save more space when folded.

In particular, the example ramp 1 shown in FIGS. 10 to 15 is formed such that the side frames 15, 20 which support the arcuate surface 7 have a triangular cross section (or are shaped similar to a triangular prism). Accordingly, when in the open position, the side frames 15, 20 can be supported by a supporting device 60.

In this particular example, the supporting device 60 includes a support arm 56 which is hingeably attached at 54 to a supporting side 55 of the frames 15, 20. Thus, the supporting arm 56 can rotate through a ninety degree angle away from the supporting side 55 such that the supporting side 55 and the supporting arm 56 can be connected by a connecting rod (or brace) 52, and the side frames 15, 20 can be supported by the supporting device 60. Furthermore, when moving the ramp 1 into the closed position, the connecting rod 52 can be removed and the supporting arm 56 can be folded towards the supporting side 55, which allows for the supporting side 55 to rest on the main frame 10, when the ramp 1 is in the closed position (this is particularly shown in FIG. 15).

Figure 10:
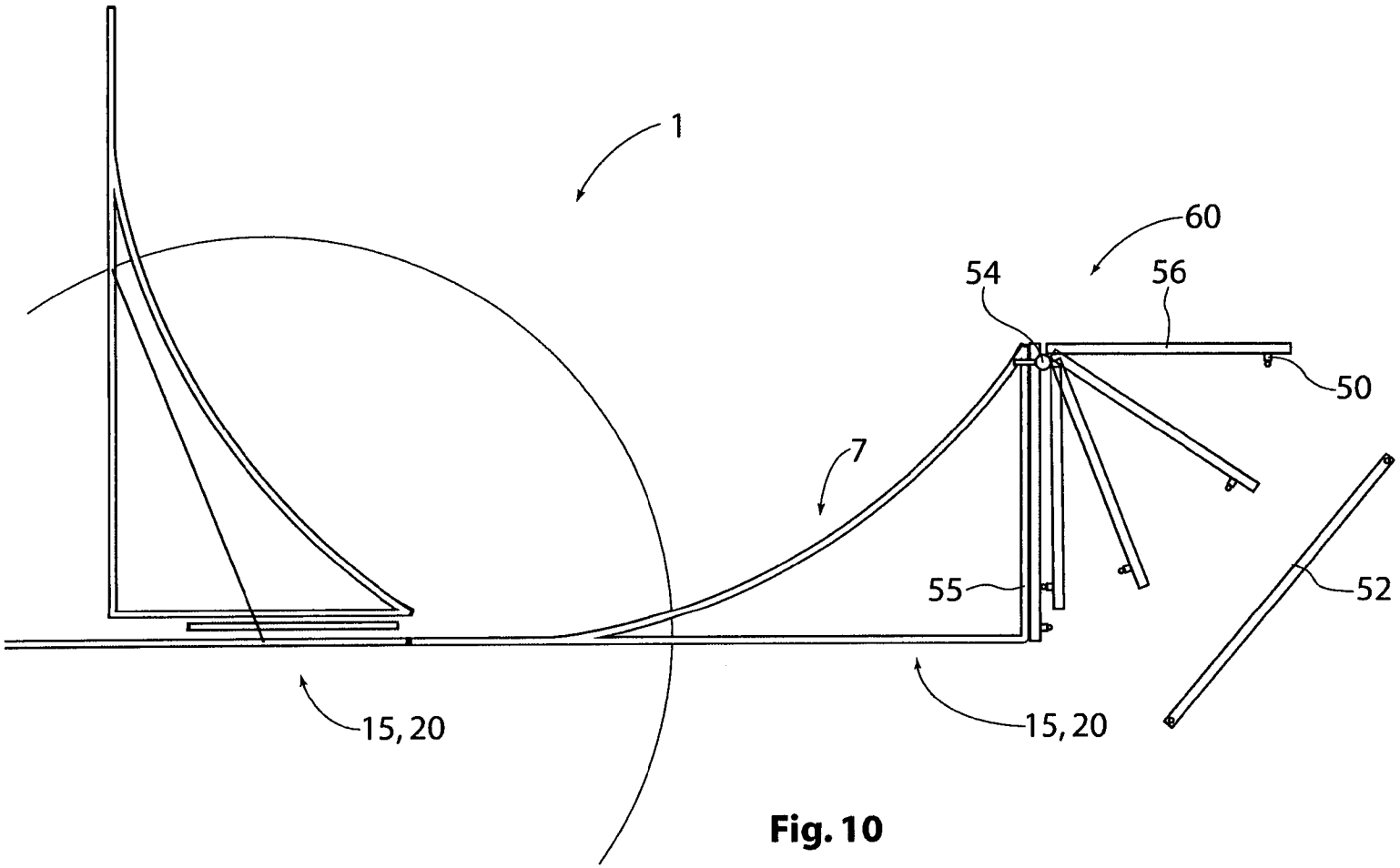
FIG. 10 is a schematic diagram of an example of another example of a ramp.
Figure 11:
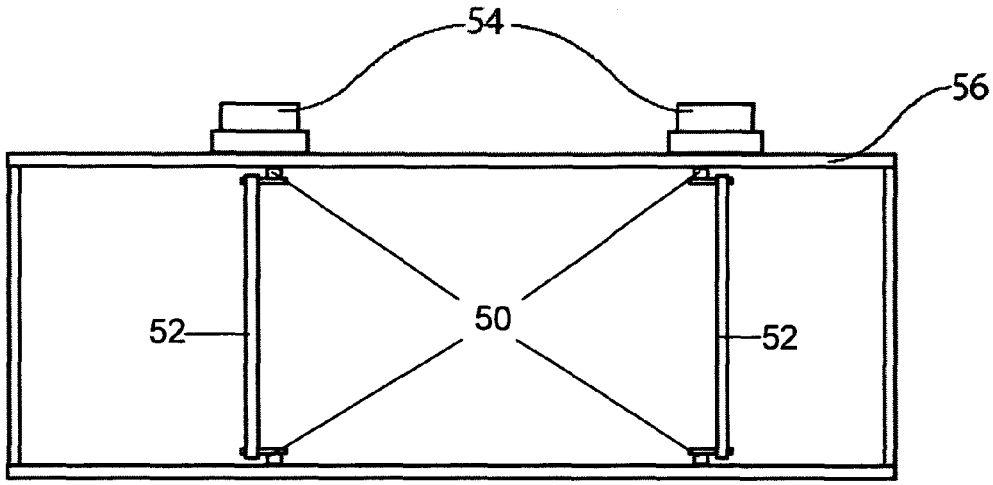
FIG. 11 is a schematic diagram of an example of a side view of the ramp of FIG. 10.
Figure 12:
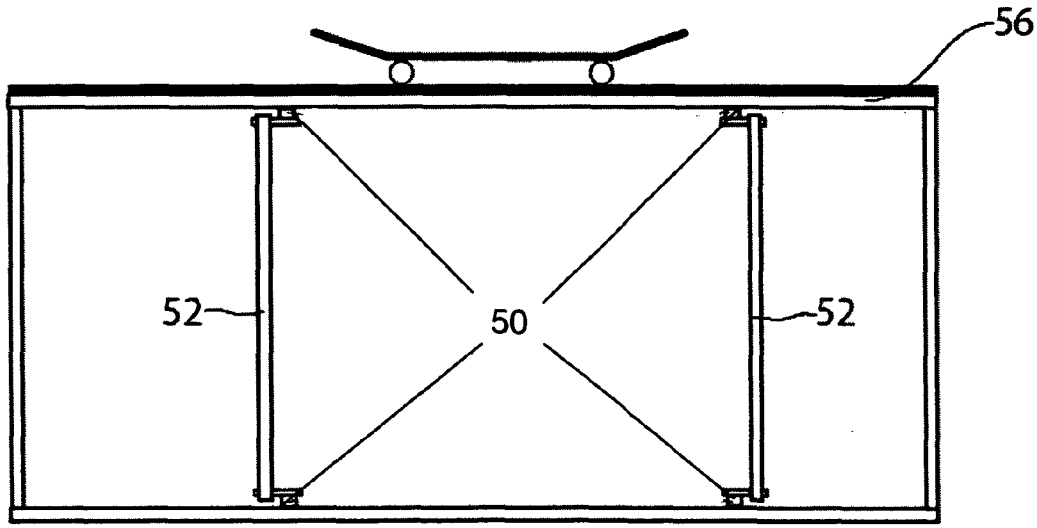
FIG. 12 is a schematic diagram of an example of another side view of the ramp of FIG. 10.
Figure 13:
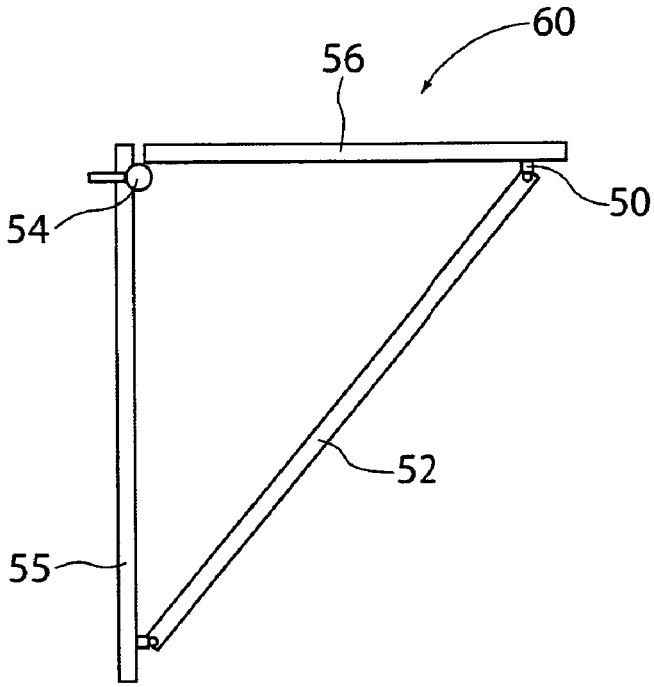
FIG. 13 is a schematic diagram of an example of a supporting device which can be used with the ramp of FIG. 10.
Figure 14:
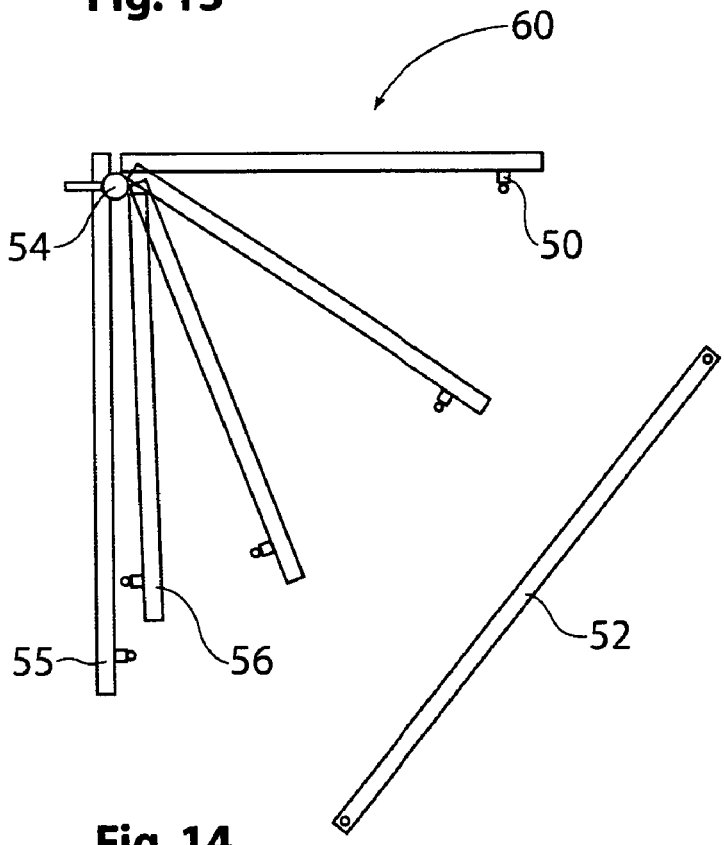
FIG. 14 is a schematic diagram of an example of the supporting device of FIG. 13 in motion; and, FIG. 15 is a schematic diagram of an example of the ramp of FIG. 10 being moved into a closed position.
Figure 15:
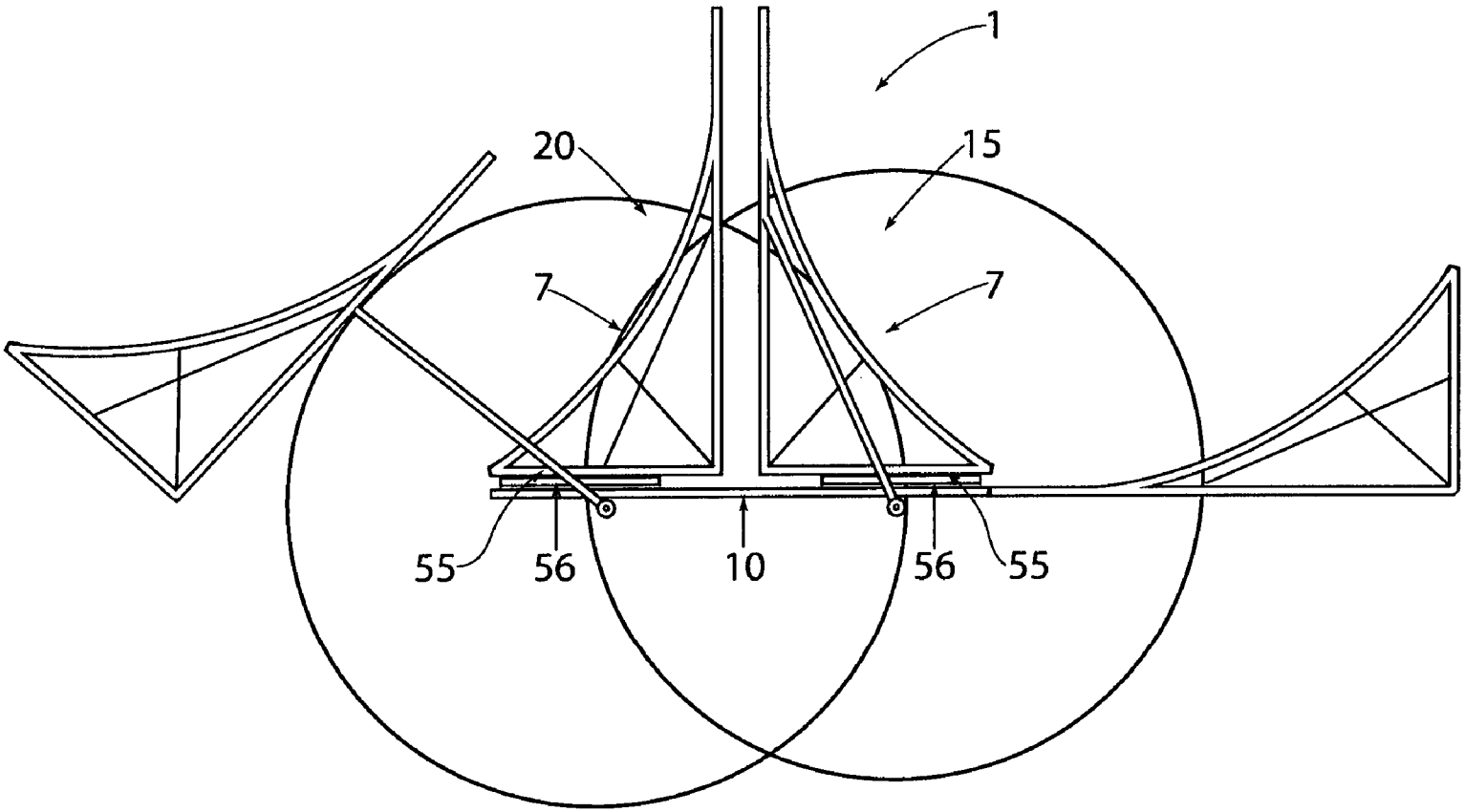

Accordingly, FIG. 10 shows that with the aid of hinges 54 that attach the supporting arm 56 to the supporting side 55, this can allow for the supporting arm 56 to fold towards the supporting side 55 when the brace 52 is removed. FIG. 11 shows an example side view of the supporting arm 56 where a plurality of connecting rods 52 are in position and locked on the pins 50. The two hinges 54 are on one side of the supporting arm 56 that connects to frame at 55. FIG. 12 shows the Braces 52 locked on the locking pins 50 when viewing from the other side, and FIG. 13 is a side view of the supporting device 60 when in a locked position. FIG. 14 shows removal of the brace 52 from the locking pins 50 which can allow the supporting arm 56 to be folded downwards with help of the hinges 54, such that at least a portion of the supporting device 60 lies on the main frame 10 when the ramp 1 is in the closed position (as shown in FIG. 15, which can allow for space to be saved in storage when the ramp 1 is folded).

Notably, it will be appreciated that the radius of the arcuate surfaces 7 can be formed such that the arcuate surfaces form a substantially flat portion before joining with the substantially flat surface 5 of the main frame 10. This can allow for a smooth transition between the various surfaces of the ramp portions.

Furthermore, an additional surface can laid on top of the ramp portions 10, 15, 20, 30A and 30B in order to achieve a smooth transition between the frames 10, 15 and 20 the radius. It will be appreciated that this can allow the seamless run from arcuate surfaces 7 into flat portion of the main frame 10 before the connecting gap. Thus, this can allow for, when in use a smooth transition between the surfaces, which limits and disturbances to momentum achieved by skateboarders or the like. Notably, the surface laid will take the shape given by the arcuate and flat surfaces 5, 7. It will further be appreciated that the frames 10, 15, and 20 with their respective surfaces can be manufactured by any means, including by the use of cross-braces (not shown), or the like.

Accordingly, there is provided herein an apparatus that can be used for sporting purposes and physical exercise, and in particular a ramp which may be used as a skateboard ramp (or mini-ramp) that is able to be folded in such a way so that the space occupied by the ramp is minimised and furthermore, the ramp can be easily stored. The ramp can also include wheels in order to allow for easy movement.

In one particular example, the foldable skateboard mini-ramp described has wheels made which are placed on three base frames, two box shaped frames, and four levers, that will fold together with help of the handrails that are permanently affixed and perform the dual function of safety and can also be an integral part of the folding leverage mechanism. Notably, according to another example, the four levers 25 that hold the frames together, and act like hinges. Furthermore, the side frames are especially designed to move towards the middle in a upright motion. The mini-ramp can stand on wheels once it is folded, it can be easily stored away, that is, it is mobile.

Thus, it will be appreciated that the ramp described herein can allow any individual person to acquire skills in skateboarding on a smaller scale, and be much less invasive within a landscape. Furthermore, it is not necessary to share the skateboarding space with others, and only requires one person to fold the ramp into it's parking position. Additionally, when the foldable ramp is in its parked (folded, stored, or closed) position it uses only a fraction of the required floor space in contrast to when the ramp is in the open position (or useable position).

Notably, it will be appreciated that the term "closed position" referred to herein can be used to refer to the position of the ramp, when the ramp is not open, or substantially in a folded, stored, stowed, or parked position. The term "open position" referred to herein can be used to refer to the position of the ramp when the ramp is not in the closed position, and can also be referred to as a useable position.

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

The claims defining the invention are as follows:

1. A ramp for sporting activities, the ramp including:

a) a main frame having a substantially flat surface; and, b) two side frames, each of the two side frames having substantially arcuate surfaces, and being attached to either side of the main frame, wherein, the ramp is moveable between open and closed positions such that when in the closed position, the two side frames sit on the main frame with their respective arcuate surfaces facing away from each other.

2. The ramp of claim 1, wherein sporting activities includes skateboarding, BMX or bicycle riding, inline skating and/or roller skating.

3. The ramp of claim 1, wherein when in the open position, the flat and arcuate surfaces for a substantially smooth surface for skateboarding.

4. The ramp of claim 3, wherein the two side frames are moveable towards the main frame, and are hingably attached to the main frame such that the two side frames are rotatable with respect to the main frame for placing the two side frames on the main frame and rotating the two side frames to by a ninety degree angle thereby forming the closed ramp position.

5. The ramp of claim 4, wherein the two side frames are attached to the main frame with at least one lever, the lever being used to lift and rotate the two side frames.

6. The ramp of claim 5, wherein the at least one lever includes one or more wheels for aiding movement of the two side frames.

7. The ramp of claim 3, wherein the two side frames includes wheels for aiding movement of the ramp portions.

8. The ramp of claim 7, wherein each of the two side frames include a supporting device for supporting the side frame when in the open position.

9. The ramp of claim 3, wherein each of the two side frames have a handrail attached thereto.

10. The ramp of claim 3, wherein the two side frames include a box-shaped frame supporting the arcuate surface.

11. The ramp of claim 3, wherein the two side frames include a triangular prism shaped frame supporting the arcuate surface.

12. A method for moving a ramp between an open position and a closed position, the ramp including:

a) a main frame having a substantially flat surface; and, b) two side frames, each of the two side frames having substantially arcuate surfaces, and being attached to either side of the main frame, wherein, the ramp is moveable between open and closed positions such that when in the closed position, the two side frames sit on the main frame with their respective arcuate surfaces facing away from each other.

13. The method of claim 12, wherein the ramp is the ramp of claim 1.

14. A ramp for sporting activities, comprising:

a center portion having a substantially flat riding surface; and two end portions having substantially curved riding surfaces, wherein the ramp is movable between an open configuration, wherein the center portion is positioned between the end portions such that the planar and curved riding surfaces provide a substantially continuous riding surface, and a closed configuration, wherein the end portions are positioned substantially above the center portion such that the respective curved surfaces of the end portions face away from one another.

15. A ramp as claimed in claim 14, wherein the end portions are hingedly attached to the center portion.

16. A ramp as claimed in claim 14, wherein each end portion is hingedly attached to the center portion by a respective attachment member, one end of each respective attachment member being pivotally coupled to the center portion, and, the other end of each respective attachment member being pivotally coupled to a respective end portion.

* * * * *